United States Patent [19]

Bovensiepen

[11] Patent Number: 4,471,579

[45] Date of Patent: Sep. 18, 1984

[54] LAPPING OR POLISHING MACHINE

[75] Inventor: Hans-Joachim Bovensiepen, Rendsburg, Fed. Rep. of Germany

[73] Assignee: Peter Wolters, Rendsburgh, Fed. Rep. of Germany

[21] Appl. No.: 393,311

[22] Filed: Jun. 29, 1982

[30] Foreign Application Priority Data

Jul. 22, 1981 [DE] Fed. Rep. of Germany ..... 3128880

[51] Int. Cl.[3] ..... B24B 49/14

[52] U.S. Cl. ..... 51/165.73; 51/109 R; 51/131.1; 51/356; 51/322

[58] Field of Search ..... 51/109 R, 129, 131.1, 51/131.2, 131.3, 165.73, 356, 266, 267, 322

[56] References Cited

U.S. PATENT DOCUMENTS

| | | | |
|---|---|---|---|
| 23,367 | 5/1951 | Garrison et al. | 51/165.73 |
| 1,513,813 | 11/1924 | Hill et al. | 51/165.73 |
| 3,562,964 | 2/1972 | Day | 51/356 |
| 4,007,560 | 2/1977 | Janssen | 51/131.3 |

*Primary Examiner*—Frederick R. Schmidt
*Assistant Examiner*—Judy J. Hartman
*Attorney, Agent, or Firm*—Holman & Stern

[57] ABSTRACT

Lapping or polishing machine, wherein for cooling a plurality of zones of its working face the tool comprises for each of these zones separate supply conduits for fluids at different temperatures and/or rates of throughflow, and there are also provided temperature sensing means with an apparatus for controlling the temperature or rate of throughflow of the fluid.

4 Claims, 3 Drawing Figures

LAPPING OR POLISHING MACHINE

When working with a rotating lapping wheel or a rotating polishing wheel, differences are often caused in the stressing of the working face due to differences in the lapping speed, differences in the distribution of lapping mixture, and differences in the pressure per unit of area. As a result there is an unequal distribution of temperature over the lapping wheel. Consequently, the predetermined shape of the working face may change undesirably. The quality of the workpiece is then detrimentally influenced both by the different temperature and also due to the deformation of the lapping wheel. Many lapping tasks can be carried out only with a specific lapping wheel temperature.

It is known to provide lapping wheels with a chamber or with a plurality of inter-connected chambers through which a fluid flows which discharges all the surplus heat of the lapping wheel. It has been found that when using that system more particularly in the case of large lapping wheels, the working face of the lapping wheel cannot be kept at the same temperature in all regions if the temperature produced by the lapping work differs at different regions of the working face.

An object of the present invention is to keep the working face of the lapping wheel at the same temperature in all regions under any lapping stressing.

According to the present invention this object is achieved by a plurality of zones of that face of the lapping wheel which is opposite from the working face of the said wheel, comprising separate supply ducts for fluids at different temperatures and/or rates of throughflow, a temperature sensor for each zone of the working face which corresponds to one of the afore-mentioned zones, said temperature sensors being connected with a device for controlling the temperature or the throughflow rate of the fluid.

Preferably that face of the lapping wheel which is opposite from the working face comprises a plurality of annular recesses each having an inlet and an outlet for the fluid. These recess are preferably connected with their own conduit which leads to its own annular groove of a part rotating with the drive shaft of the lapping wheel.

The same arrangements according to the invention can also be provided in the case of polishing machines.

The invention is described hereinafter with reference to a constructional example of a lapping machine with an annular shape of the lapping wheel.

Figure 1:
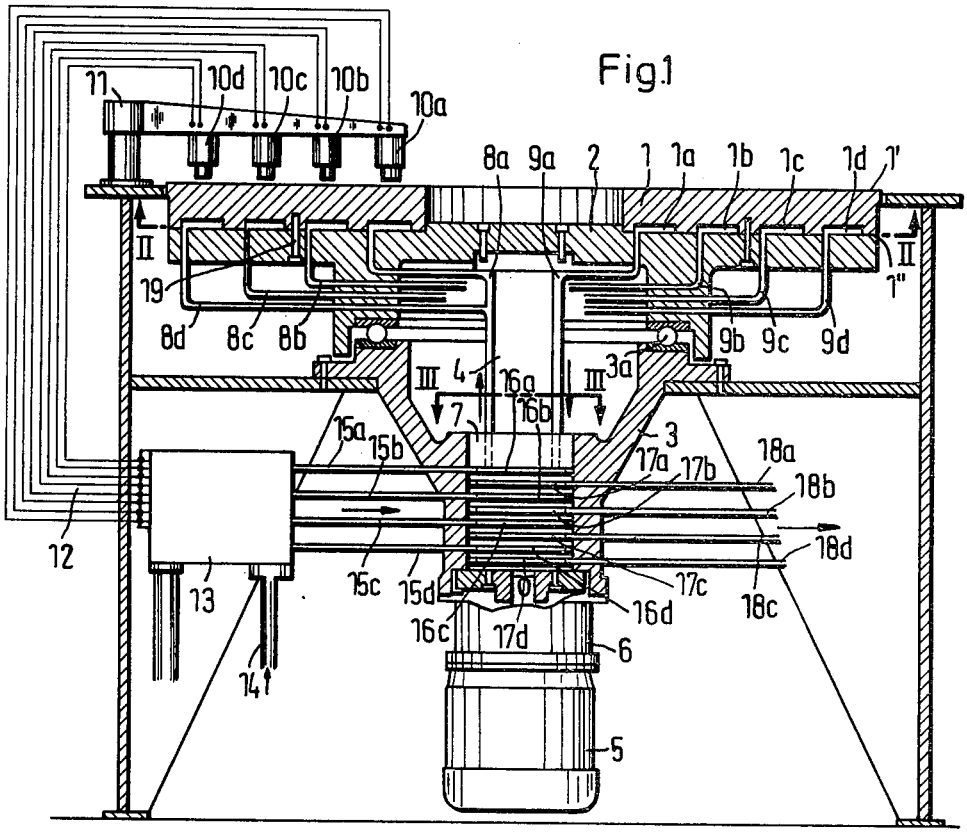
FIG. 1 shows a vertical section taken on the line I—I of FIG. 2.
Figure 3:
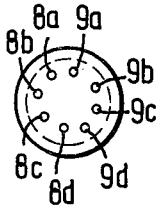
FIG. 3 shows a plan view of the larger-diameter portion of the drive shaft.
Figure 2:
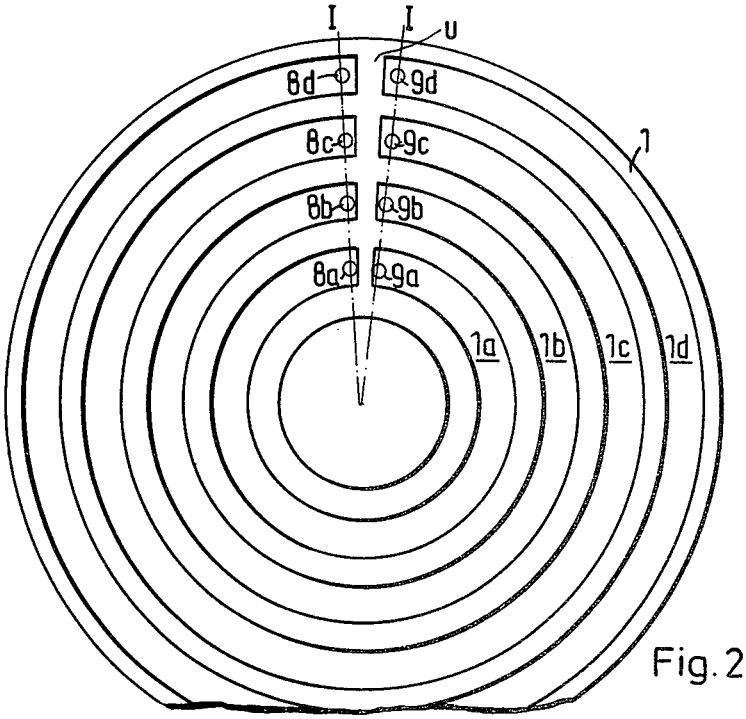
FIG. 2 shows a view from below of the lapping wheel of FIG. 1.

The illustrated lapping machine has a lapping wheel 1 which is in the form of a circular disc and whose rear side is secured by means of screws 19 on a supporting flange 2, which can be rotated by a shaft 4 by means of a motor 5 by way of a transmission 6. The shaft 4 comprises a portion 7 of somewhat larger diameter which is mounted in a bearing 3 supporting by means of a ball bearing 3*a* the supporting flange 2.

The rear side 1″ of the lapping wheel 1 comprises four recesses 1*a*,1*b*,1*c*,1*d* which are in the form of concentric annular grooves interrupted at a location u. One end of these annular grooves is connected to a conduit 8*a*,8*b*,8*c*,8*d* respectively and the other end to a conduit 9*a*,9*b*,9*c*,9*d* respectively. The conduits 8*a* to 8*d* lead to annular grooves 16*a* to 16*d* of the portion 7, whilst the conduits 9*a* to 9*d* lead to annular grooves 17*a* to 17*d* of the portion 7. Externally the annular grooves are closed by the bearing 3. Conduits 15*a* to 15*d* lead to the annular grooves 16*a* to 16*d*; conduits 18*a* to 18*d* lead to the annular grooves 17*a* to 17*d*.

Provided above the horizontal working face 1′ of the lapping wheel 1 is an arm 11 supporting four measuring elements 10*a*, 10*b*, 10*c*, 10*d* situated in each case above the recesses 1*a*,1*b*,1*c*,1*d* of the lapping wheel 1. These are measuring elements which ascertain the temperature of the working face 1′ of the lapping wheel, for example on the principle of direct temperature measurement or measurement of a variation in length corresponding to the temperature variations. The measuring elements 10*a* to 10*d* are connected via lines 12 to a device 13 in which a fluid introduced through a feed conduit 14 is brought in separate quantities to different temperatures, which correspond in such a manner to the temperatures detected by the measuring elements 10*a* to 10*d* that when these quantities of fluid are supplied to the recesses 1*a* to 1*d* the temperature of the working face 1′ of the lapping wheel is kept at the same level everywhere.

The device 13 connects with the recesses 1*a* to 1*d* via conduits 15*a*,15*b*,15*c*,15*d* and conduits 8*a*,8*b*,8*c*,8*d*. The conduits 15*a* to 15*d* extend through bores in the bearing body 3 and debouch there into peripheral grooves 16*a*,16*b*,16*c*,16*d* of the portion 7 of the drive shaft 4. Conduits 8*a* to 8*d* open into these grooves 16*a* to 16*d*, so that the fluid which has been brought in the device 13 to a temperature corresponding to the temperature ascertained by the measuring element 10*a*, in other words serves for compensating for the temperature of the working surface 1′ of the lapping wheel, is supplied via the conduit 15*a*, the annular groove 16*a* and the conduit 8*a* to the recess 1*a*. In the same way, fluids which have been brought to the appropriate temperature by the device 13 are supplied to the recesses 1*b*,1*c*,1*d* by way of the conduits 15*b* to 15*d*, the annular grooves 17*b* to 17*d* and the conduits 8*b* to 8*d*. The fluids supplied to the recesses 1*a* to 1*d* are discharged via conduits 9*a* to 9*d*, annular grooves 17*a* to 17*d* and conduits 18*a* to 18*d*. In the case of the illustrated machine a polishing wheel can be used instead of a lapping wheel.

The lapping wheel can comprise appropriate cavities in its interior instead of recesses 1*a* to 1*d* which form chambers, closed after the lapping wheel 1 is placed on the supporting flange 2.

Instead of separate annular grooves 17*a* to 17*d* the portion 7 can comprise—besides the annular grooves 16*a* to 16*d*—a single annular groove into which all-the conduits 9*a* to 9*d* open, and then the discharge conduits 18*a* to 18*d* are replaced by a single conduit. The separate conduits 9*a*–9*d* can be replaced by a common conduit for returning the fluid from the compartments 1*a*–1*d*.

I claim:

1. A lapping or polishing machine comprising a tool which consists of a flat wheel having on its rear face a plurality of separate concentric annular zones, a plurality of separate supply ducts for supplying fluid to each individual annular zone at different temperatures and/or speeds of throughflow, a respective plurality of separate removal ducts for removing said fluid from each individual annular zone, a plurality of temperature sensors each being located proximate of a working face of the tool and situated above said concentric annular zones, and a device connected to said temperature sensors to the respective supply ducts for controlling the temperature and/or the throughflow rate of the fluid to said concentric annular zones.

2. The machine according to claim 1 wherein said cencentric annular zones are recesses provided in said rear face of the tool.

3. The machine according to claim 2, wherein said recesses are closed by a flange supporting the tool and having openings corresponding to said supply and removal ducts.

4. The machine according to claim 2, wherein each of said supply and removal ducts lead to an annular groove provided in a part rotating with a shaft driving the tool, said grooves debouching in conduits not rotating with said shaft.

* * * * *